US006001481A

United States Patent [19]

Dearnaley et al.

[11] Patent Number: 6,001,481

[45] Date of Patent: Dec. 14, 1999

[54] POROUS ANODIZED ALUMINUM SURFACES SEALED WITH DIAMOND-LIKE CARBON COATINGS

[75] Inventors: Geoffrey Dearnaley, San Antonio, Tex.; Stephen J. Lukezich, Huber Heights, Ohio

[73] Assignee: Southwest Research Institute, San Antonio, Tex.

[21] Appl. No.: 09/026,451

[22] Filed: Feb. 19, 1998

Related U.S. Application Data

[62] Division of application No. 08/662,728, Jun. 10, 1996, Pat. No. 5,863,621, which is a continuation of application No. 08/400,612, Mar. 8, 1995, abandoned.

[51] Int. Cl.[6] ..... B32B 9/00

[52] U.S. Cl. ..... 428/408; 428/312.2; 428/312.8; 428/318.4; 428/319.1; 428/457; 428/446

[58] Field of Search ..... 428/408, 457, 428/469, 446, 312.2, 312.8, 318.4, 319.1

[56] References Cited

U.S. PATENT DOCUMENTS

| | | | |
|---|---|---|---|
| 5,000,831 | 3/1991 | Osawa et al. | 204/173 |
| 5,116,592 | 5/1992 | Weinberg | 423/415 R |
| 5,238,705 | 8/1993 | Hayashi et al. | 427/249 |
| 5,249,554 | 10/1993 | Tamor et al. | 428/408 |
| 5,449,924 | 9/1995 | Hur et al. | 257/77 |
| 5,506,446 | 4/1996 | Hoffman et al. | 257/668 |
| 5,512,330 | 4/1996 | Dearnaley | 427/249 |
| 5,523,121 | 6/1996 | Anthony et al. | 428/408 |
| 5,631,087 | 5/1997 | Fukuda et al. | 428/408 |
| 5,728,465 | 3/1998 | Dorfman et al. | 428/408 |
| 5,740,941 | 4/1998 | Lemelson | 220/446 |

*Primary Examiner*—Archene Turner
*Attorney, Agent, or Firm*—Paula D. Morris & Associates P.C

[57] ABSTRACT

A component comprising an anodized aluminum surface comprising a diamond-like carbon sealant. In a preferred embodiment, the diamond-like carbon sealant substantially fills pores in the anodized aluminum surface, and the pores are substantially free of gas. The anodized aluminum surface and sealant form an interface which preferably is substantially free of imperfections attributable to water molecules remaining adsorbed to the surface during application of said sealant.

15 Claims, No Drawings

POROUS ANODIZED ALUMINUM SURFACES SEALED WITH DIAMOND-LIKE CARBON COATINGS

The present application is a divisional of U.S. patent application Ser. No. 08/662,728, filed Jun. 10, 1996 now U.S. Pat. No. 5,863,621 which is a continuation of U.S. patent application Ser. No. 08/400,612, abandoned, filed Mar. 8,1995.

FIELD OF THE INVENTION

The present invention relates to anodized aluminum and aluminum alloy surfaces comprising a diamond-like carbon sealant.

BACKGROUND OF THE INVENTION

Aluminum is commonly used to manufacture many different articles. When compared to steel, aluminum owes its versatility as an engineering material to its easy workability, its somewhat low specific gravity, and its relative resistance to corrosion by the ambient environment.

The resistance to corrosion exhibited by aluminum is due to the formation of a substantially transparent "natural" oxide layer upon exposure to air. The oxide layer prevents direct contact between the underlying aluminum and corrosive materials in the surrounding environment. Unfortunately, this "natural oxide" layer does not always have a uniform thickness. Because of this, natural oxides generally are removed from aluminum products, and the product thereafter is "anodized", or controllably oxidized, to provide a protective oxide layer with better quality and substantially greater thickness.

Anodizing processes generally involve the use of a bath containing an electrolyte, such as sulfuric acid, oxalic acid, chromic acid, phosphoric acid, or combinations thereof, with or without certain addition agents. The aluminum workpiece generally is used as an anode and a component made of steel or other suitable material is used as a cathode. The anode and cathode are immersed in the electrolyte solution, and a direct or alternating current is passed through the electrolyte.

Although anodizing, itself, imparts satisfactory corrosion resistance to aluminum components, anodizing also suffers from several disadvantages. One disadvantage is the porosity of the oxide formed at the surface of the aluminum component. A typical anodizing treatment results in a porous polygonal cellular microstructure superimposed on a thin (less than 100 nm) "barrier" layer. The diameter of the pores in the microstructure can be as small as 10 nm. The cell dimension can be as small as about 30 nm.

The pores formed at the surface of anodized aluminum are undesirable because they tend to serve as corrosion sites, which give rise to deep pits. Deep pits in the anodized surface often result in "blooms" or white spots on the surface of the aluminum. In order to protect anodized aluminum from corrosion, especially in halide or salt-containing environments, the pores of the aluminum oxide customarily are sealed by immersion in a hot solution containing hexavalent chromium. A complex chemical reaction occurs, forming a solid compound of chromium, aluminum, oxygen, and some hydrogen within the pores of the anodized surface. This solid compound seals the pores against penetration by corrosive agents.

Unfortunately, hexavalent chromium solutions are toxic. The use and disposal of hexavalent chromium solutions therefore creates environmental concerns. Environmental concerns, and their associated costs, have created an urgent need for alternative sealing processes that are free from such hazards. The need for alternative sealing processes is intensified because the process used to form a chromate sealant does not purge the pores of the aluminum before or while the chromate sealant is formed. As a result, at least some gas remains in many of the pores, serving as corrosion sites.

Some have attempted to develop alternative sealing processes using other chemical solutions. To date, these alternative chemical solutions have not been entirely successful. A non-toxic, effective method for sealing anodized aluminum surfaces is urgently needed.

One obstacle to the development of alternative methods for sealing anodized aluminum surfaces is the fact that most anodizing treatments require that the aluminum component be immersed in an aqueous electrolyte solution. Even after drying, a film of water molecules (about two monolayers thick) tends to remain strongly adsorbed to the anodized surface. Where the anodized surface will be treated with a relatively hydrophilic sealant, the presence of adsorbed water molecules should not interfere with the sealing process. However, if the anodized surface will be treated with a hydrophobic sealant, the adsorbed water molecules could interfere with the sealing process, e.g., creating gaps or other imperfections which could serve as corrosion sites.

The removal of water molecules from an anodized aluminum surface is not a simple matter. Water molecules are polar, and thus have a charge distribution within the molecules, themselves. The attraction between the anodized surface and the polarized water molecules creates a weak bond which holds the water molecules to the anodized surface. In order to break this weak bond, the water molecules must be provided with enough energy to break free from the anodized aluminum surface.

A number of methods exist for freeing adsorbed water molecules from various surfaces. These methods include exposing the anodized surface to: sonar energy; heat; a flow of inert gas; a beam of de-focused electrons; and, UV light.

The use of sonar energy to free adsorbed water molecules has proven to be time consuming and not entirely successful. Heating of the surface is more successful in actually desorbing the water molecules from the surface; however, not all of the adsorbed water molecules are removed by heat, and the application of heat can be cumbersome and time consuming. A flow of inert gas, such as nitrogen, removes some adsorbed water molecules; however, the movement of the gas molecules is random, and it is unlikely to remove all of the adsorbed water molecules. Whether de-focused electrons accelerated in a vacuum can successfully remove adsorbed water molecules from an anodized surface is not known; however, the technique has not been used commercially.

Water molecules absorb certain wavelengths of UV light. The absorbed energy should excite the water molecules into a vibrational mode, freeing the water molecules from the surface to which they are adsorbed. However, the UV light that has been used in the past to desorb water molecules from various surfaces has been relatively high intensity, or short wavelength UV light. The conventional source of UV light is a mercury vapor lamp. In most mercury vapor lamps, essentially all radiation having a wavelength shorter than 200 nm is shut off by a silica envelope. Water has a low coefficient of absorption in the wavelength ranges produced by mercury vapor UV lamps. As a result, a relatively long period of time has been required to desorb water molecules from a surface using relatively long wavelength UV light.

The development of effective alternative sealing methods for anodized aluminum surfaces will be advanced if more efficient and effective methods are developed to remove adsorbed water molecules from such surfaces.

SUMMARY OF THE INVENTION

The present invention provides an anodized aluminum surface comprising a diamond-like carbon sealant.

DETAILED DESCRIPTION OF THE INVENTION

The present invention is directed to anodized "aluminum" surfaces bearing a diamond-like carbon sealant. As used herein, the word "aluminum" is defined to mean aluminum and alloys thereof that are amenable to anodization. A flowable precursor material to the diamond-like carbon sealant preferably is applied to the porous anodized aluminum surface in a vacuum, as explained more fully below. The application of the precursor material in a vacuum causes the precursor material to penetrate the pores in the surface of the anodized aluminum, and push any remaining gas out of the pores. The precursor material then is converted into diamond-like carbon by application of energy, preferably in the form of an ion beam. The result is an adherent interface between the anodized aluminum surface and the a diamond-like carbon sealant, which is chemically inert and impermeable, and forms a mechanically strong surface that will withstand exposure to high temperatures.

Because a diamond-like carbon sealant is relatively hydrophobic, it is important to treat the anodized aluminum surface to remove any adsorbed water molecules before applying the sealant. It was determined that water molecules have a much higher coefficient of absorption for UV light with a shorter wavelength, in the region of 120–150 nm, than for the longer wavelength UV light produced by conventional UV lamps. Exposure of adsorbed water molecules to low intensity UV light was found to result in more rapid, and more effective desorption of water molecules from the anodized aluminum surface.

Short wavelength UV radiation can be obtained using unconventional UV lamps, such as deuterium discharge lamps. Deuterium discharge lamps generate UV radiation having wavelengths down to 120 nm. These lower wavelength UV lamps can be modified, using special windows formed of substances such as magnesium fluoride, to transmit radiation down to wavelengths of about 110 nm.

To treat an anodized aluminum component, the component should placed in a vacuum chamber provided with: (a) a source of short wavelength low intensity UV radiation; (b) a reservoir for vaporizing the precursor sealant fluid and directing the vapor onto the component; and (c) an ion gun or other suitable apparatus for accelerating ions and bombarding the component with an energetic beam of ions.

The pressure in the vacuum chamber should be pumped down to at least about $10^{-6}$ torr. In a preferred embodiment, a 150 watt UV lamp is used to produce UV radiation in the range of about 110–180 nm, preferably between about 120–150 nm. The surface of the anodized aluminum should be exposed to a flux of this low intensity UV radiation for a time sufficient to remove adsorbed water molecules from the anodized surface. Using a 150 watt lamp and 120–150 nm UV light, this should take about 20 minutes.

In a preferred embodiment, the vacuum chamber reservoir is supplied with electrical resistance heating. The reservoir contains a selected precursor fluid in an amount sufficient to volatilize and coat the component. Suitable precursor materials are diffusion pump materials which have a low vapor pressure and can be vaporized stably at room temperature. Examples of suitable diffusion pump fluids include, but are not necessarily limited to: polyphenyl ether; elcosyl naphthalene; i-diamyl phthalate; i-diamyl sebacate; chlorinated hydrocarbons; n-dibutyl phthalate; n-dibutyl sebacate; 2-ethyl hexyl sebacate; 2-ethyl hexyl phthalate; di-2-ethylhexyl sebacate; tri-m-cresyl phosphate; tri-pcresyl phosphate; dibenzyl sebacate. Other suitable precursors are the vacuum-distilled hydrocarbon mineral oils manufactured by Shell Oil Company under the trademark APIEZON. Of this group, Apiezon A, Apiezon B, Apiezon C, and Apiezon D are the most appropriate. Other preferred DLC precursors are siloxanes, such as polydimethyl siloxane, pentaphenyltrimethyl siloxane, and other silicon containing diffusion pump fluids, preferably pentaphenyl-trimethyl siloxane. Preferable diffision pump fluids include polyphenyl ether, polydimethyl siloxane, pentaphenyltrimethyl siloxane, and elcosyl napthalene.

Preferably, the reservoir should be heated to an appropriate temperature to vaporize the selected precursor, and the resulting vapor flux should be directed through an aperture or nozzle to direct the flux toward the surface to be sealed until a preferred coating thickness of between about 1–5$\mu$ is achieved. The thickness of the coating may be monitored by standard methods, e.g., using the frequency change of a quartz crystal oscillator.

At the same time, the component should be bombarded, either in a continuous or interrupted fashion, with an energetic beam of ions, preferably ionized gaseous species such as hydrogen, helium, neon, nitrogen, argon, methane, carbon monoxide, or other relatively low mass gaseous elements or compounds. The energy of bombardment must be sufficient to ionize the constituent molecules in the precursor film, and to rupture the bonds between hydrogen and other atoms, such as carbon and silicon, thereby releasing the hydrogen into the surrounding vacuum to be pumped away. The energy of bombardment can range from between about 1 keV to about 1 MeV, but preferably should be between about 20 keV to about 100 keV.

The "ion arrival ratio" should be controlled in relation to the rate of arrival of the precursor molecules. The "ion arrival ratio" is defined as the ratio of each arriving ion to the number of precursor molecules present at the surface of the component. The ion arrival ratio preferably should be at least 1 ion for every molecule of precursor. This process should require about one ion for every 100 atoms in the final product coating; however, the required ion-to-atom ratio will vary according to the mass and energy of the ion species. Typically, 100 eV must be deposited for each carbon atom in the coating. Persons of ordinary skill in the art can relate the ion beam current per unit area to the arrival rate of precursor molecules.

The ion bombardment should be continued until the precursor molecules are ionized and converted into an inert, solid, impermeable, and mechanically strong material. The amount of time required to achieve this conversion will vary with the intensity of the ion beam. At an ion-to-atom ratio of 1 to 100 and an energy of about 20 keV to about 100 keV, about 30 minutes of ion bombardment should be sufficient. Depending upon the chemical nature of the precursor, the resulting surface should be carbonaceous, silicaceous, or a blend of carbon and silicon product, with some residual hydrogen and—if oxygen was present in the precursor—residual oxygen.

Persons of skill in the art will appreciate that many modifications may be made to the embodiments described herein without departing from the spirit of the present invention. Accordingly, the embodiments described herein are illustrative only and are not intended to limit the scope of the present invention.

We claim:

1. An aluminum or aluminum alloy component comprising a surface converted to anodized aluminum, said anodized aluminum surface further comprising pores filled with a substance consisting essentially of a diamond like carbon sealant.

2. The component of claim 1 wherein said diamond-like carbon sealant comprises materials selected from the group consisting of carbonaceous materials, silicaceous materials, and mixtures thereof.

3. The component of claim 2 wherein said surface comprises pores substantially filled with said sealant.

4. The component of claim 3 wherein said pores are substantially free of gas.

5. The component of claim 4 wherein said sealant forms an interface with said anodized aluminum surface, and said interface is substantially free of imperfections.

6. The component of claim 3 wherein said sealant forms an interface with said anodized aluminum surface, and said interface is substantially free of imperfections attributable to water molecules remaining adsorbed to said surface during application of said sealant.

7. The component of claim 2 wherein said surf ace comprises pores which are substantially free of gas.

8. The component of claim 7 wherein said sealant forms an interface with said anodized aluminum surface, and said interface is substantially free of imperfections attributable to water molecules remaining adsorbed to said surface during application of said sealant.

9. The component of claim 2 wherein said sealant forms an interface with said anodized aluminum surface, and said interface is substantially free of imperfections attributable to water molecules remaining adsorbed to said surface during application of said sealant.

10. An aluminum or aluminum alloy component comprising a surface converted to anodized aluminum, said anodized aluminum surface comprising pores substantially filled with a substance consisting essentially of diamond-like carbon sealant.

11. The component of claim 10 wherein said pores are substantially free of gas.

12. The component of claim 11 wherein said sealant forms an interface with said anodized aluminum surface, and said interface is substantially free of imperfections attributable to water molecules remaining adsorbed to said surface during application of said sealant.

13. An aluminum or aluminum alloy component comprising a surface converted to anodized aluminum, said anodized aluminum surface comprising pores which are substantially free of materials other than a diamond-like carbon sealant .

14. The component of claim 13 wherein said sealant forms an interface with said anodized aluminum surface, and said interface is substantially free of imperfections attributable to water molecules remaining adsorbed to said surface during application of said sealant.

15. An aluminum or aluminum alloy component comprising:

a surface converted to anodized aluminum, said anodized aluminum surface comprising pores substantially filled with a diamond-like carbon sealant;

an interface between said anodized aluminum surface and said sealant, said interface being substantially free of unperfections attributable to water molecules remaining adsorbed to said surface during application of said sealant.

* * * * *

UNITED STATES PATENT AND TRADEMARK OFFICE

CERTIFICATE OF CORRECTION

PATENT NO. : 6,001,481

DATED : December 14, 1999

INVENTOR(S) : Geoffrey Dearnaley, and Stephen J. Lukezich

It is certified that error appears in the above-identified patent and that said Letters Patent is hereby corrected as shown below:

Column 6, line 32 delete "unperfections" and insert –imperfections--

Signed and Sealed this

Twenty-fifth Day of July, 2000

*Attest:*

*Attesting Officer*

Q. TODD DICKINSON

*Director of Patents and Trademarks*